United States Patent [19]

Bianchetta

[11] 4,041,983

[45] Aug. 16, 1977

[54] PRESSURE CONTROLLED SWING VALVE WITH SAFETY FEATURE

[75] Inventor: Donald L. Bianchetta, Coal City, Ill.

[73] Assignee: Caterpillar Tractor Co., Peoria, Ill.

[21] Appl. No.: 594,392

[22] Filed: July 9, 1975

[51] Int. Cl.[2] ..... F15B 13/042

[52] U.S. Cl. ..... 137/625.63; 91/433; 91/461; 137/624.27; 137/625.66

[58] Field of Search ..... 91/433, 461, 304, 426; 137/625.6, 625.66, 625.63, 624.27

[56] References Cited

U.S. PATENT DOCUMENTS

| | | | |
|---|---|---|---|
| 2,157,240 | 5/1939 | Keel | 137/625.63 X |
| 2,931,389 | 5/1960 | Moog, Jr. et al. | 137/625.62 |
| 2,964,059 | 12/1960 | Geyer | 137/625.62 |
| 3,267,965 | 8/1966 | Kroffke | 137/625.66 X |
| 3,511,276 | 5/1970 | Jessen et al. | 137/624.27 |
| 3,640,146 | 2/1972 | Barnes | 137/624.27 X |
| 3,650,286 | 3/1972 | Armstrong | 137/625.63 X |
| 3,746,401 | 7/1973 | Stearns | 137/624.27 X |
| 3,818,802 | 6/1974 | Wilson | 137/625.66 X |
| 3,859,791 | 1/1975 | Allen | 91/433 |

*Primary Examiner*—Irwin C. Cohen
*Attorney, Agent, or Firm*—Phillips, Moore, Weissenberger, Lempio & Majestic

[57] ABSTRACT

A pilot operated directional control valve is provided with pressure controlling means responsive to motor line pressure to control the shifting of the control valve to maintain a precisely controlled variable torque in a motor controlled thereby. The pressure controlling means includes constant force centering means for the valve and a piston at each end of the control valve with means communicating motor line pressure to the piston to operate in opposition to a piston subject to pilot control pressure for shifting the valve.

3 Claims, 3 Drawing Figures

PRESSURE CONTROLLED SWING VALVE WITH SAFETY FEATURE

BACKGROUND OF THE INVENTION

The present invention relates to control valves and pertains particularly to an implement control valve having a pressure controlled spool for obtaining precisely controlled variable torque from hydraulic motors.

Hydraulically operated implements and machines increasingly use higher rates of hyraulic flow and pressures. Such systems frequently use pressures on the order of 3000 psi to 5000 psi and volumes on the order of 50–100 gallons per minute of flow. Such high flow and pressures can result in very abrupt changes in pressure to the motor and high acceleration of the implements associated with such machines due to the high torque induced in the motor. This is especially a problem with rotary hydraulic motors wherein pilot control means is used for shifting the main control valves. Such high torque and the changes therein can cause starting and stopping as well as running away of the motor which can damage the machine as well as be uncomfortable for an operator.

Pilot operation of control valves for operation of hydraulic implements is normally employed in the prior art for remote operation as well as to reduce the effort required in movement of the controls to thereby reduce operator fatigue. Such prior art systems, however, normally have the disadvantage of a lack of precise control over positioning in relation to motor load or torque of the main control valve. The main control valve spool in such prior art systems is normally provided with rather stiff mechanical centering spring means in order to overcome the forces acting on the valve in order to shift the valve to a non-activating position. Thus, higher pressure pilot systems are required in order to shift the valves in the high pressure systems.

The centering spring pressure in such systems also tends to vary with displacement of the spool. This results in a non-linear relationship between the position of the control lever and the main control valve.

This prior art arrangement may also result in a system wherein the spool shifts quite abruptly from one position to another in view of the high forces required for such shifting. Such abrupt shifting of the control spools frequently causes rapid high acceleration of the motor from its starting position to operating speed and likewise a rapid deceleration of the motor from its operating to stopped position.

U.S. application Ser. No. 431,360 filed Jan. 7, 1974, now abandoned and assigned to the assignee hereof, is directed to a system for compensating for high pressures to control abrupt starting and stopping of a motor. However, that system fails to precisely control motor torque in direct relation to control lever position.

Attempts heretofore known to provide pilot operated control systems capable of more closely controlling the main control spool has resulted in very complex and expensive systems.

SUMMARY AND OBJECTS OF THE INVENTION

In accordance with the primary aspect of the present invention, there is provided a pilot operated motor control valve which is provided constant force centering means and with motor pressure responsive means for providing two of the controlling functions for controlling the pilot shifting of the control valve from its neutral position to a fluid directing position. The controlling means includes piston means responsive to motor operating pressure for acting in opposition to independent and constant pilot pressure that normally shift the valve. The pistons which act in opposition to the pilot pressure are provided with communication of operating fluid from the motor ports of the system so that the opposition to the shifting of the valve is in proportion to the pressure and/or the load on the system for maintaining a constant torque on the motor for a given control lever position.

It is, therefore, a primary object of the present invention to provide means for overcoming the above problems of the prior art.

Another object of the present invention is to provide constant torque control means for a hydraulic motor.

A further object of the invention is to provide a pressure controlled pilot operated control valve with controlling means that controls pilot shifting of the valve as a function of the load on the system and in relation to the control selector position.

BRIEF DESCRIPTION OF THE DRAWING

The above objects and advantages of the present invention will become apparent from the following description when read in conjunction with the drawings wherein.

DETAILED DESCRIPTION OF PREFERRED EMBODIMENT

Figure 1:
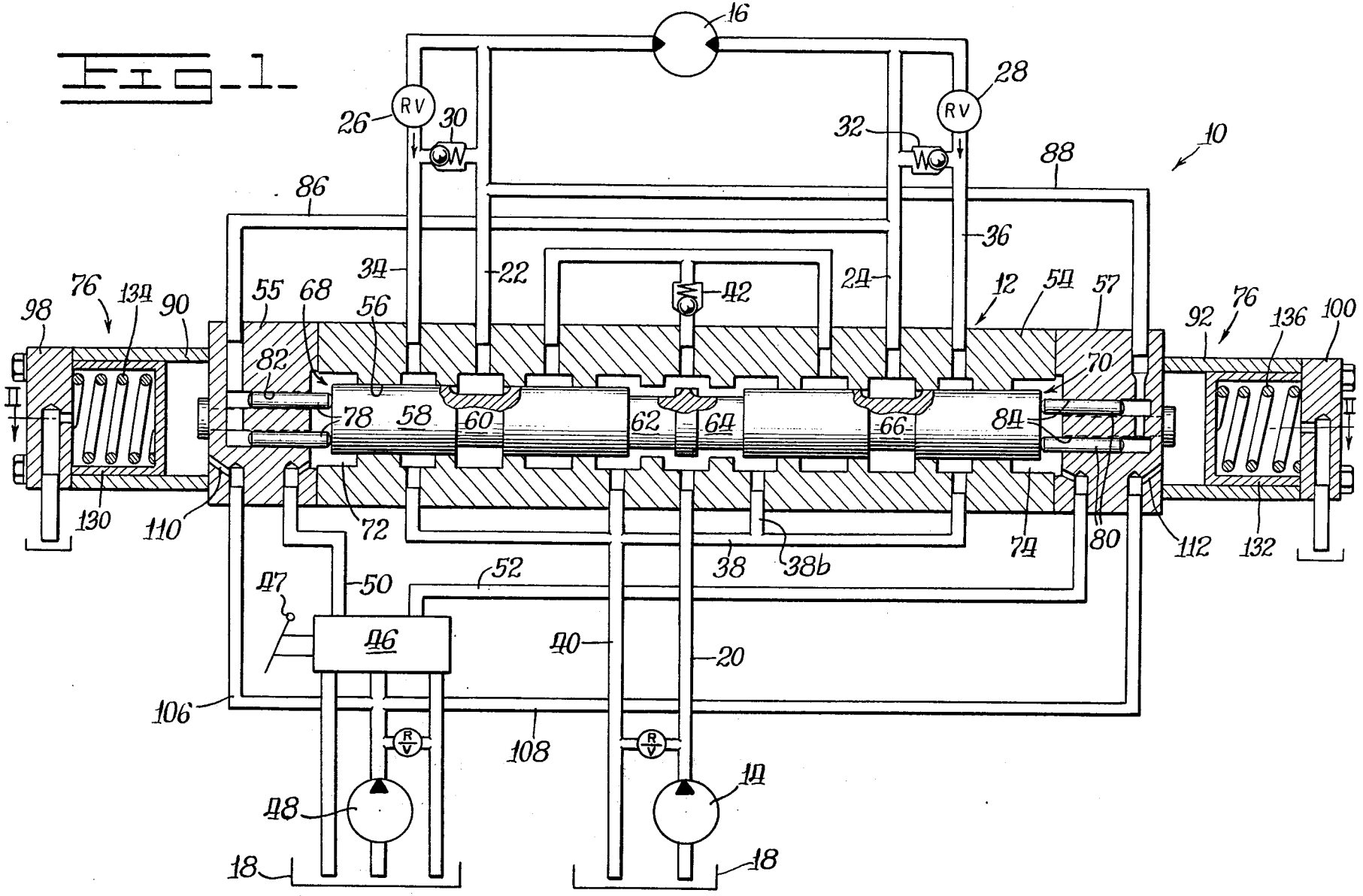
FIG. 1 is a schematic layout partially in section, of a system embodying the present invention.

Referring now to FIG. 1, there is illustrated a hydraulic control system embodying the principles of the present invention. In particular, there is illustrated a hydraulic circuit generally indicated by the numeral 10, having a pilot operated directional control valve generally indicated by the numeral 12 which is connected in the circuit for directing pressurized fluid from a primary source of high pressure motive fluid such as a supply pump 14 to a hydraulic motor such as a reversible rotary motor 16. Although the system is designed to control torque control problems associated with rotary hydraulic motors, it is that it will function for load control in linear hydraulic motors. The pump 14 is connected by conduit means in the usual manner for drawing fluid from a sump 18 and supplying it by a main supply line or conduit 20 to the directional control valve 12 which in turn selectively directs the pressure by way of high pressure motor lines 22 and 24 to the reversible hydraulic motor 16.

Suitable relief valves 26 and 28 and makeup valves 30 and 32 are provided between the high pressure motor lines 22, 24 and suitable low pressure return passages or lines 34 and 36. The return passages 34 and 36 are in communication by way of a low pressure return passage 38 with a return line 40 to tank or sump 18. A single load check 42 controls a branched supply line or passage 44 which directs fluid from the inlet to the respective motor control lines.

A suitable manually operable pilot control valve 46 is connected within a pilot control circuit for directing pilot fluid from an independent pilot pump 48 via pilot control lines 50 and 52 to suitable piston means at the opposite ends of the main control valve for selectively shifting the valve to either one of a fluid directing position from its neutral position as shown. It should be noted that the source of pilot fluid is independent from the source of primary motive fluid. The importance of this will be appreciated from the description of operation on the diagram of FIG. 3.

The main control valve 12 comprises a housing 54, having an elongated bore 56 formed therein and a pair of end caps 55 and 57 covering the ends of the bore. The bore 56 is in communication respectively, as illustrated, with the inlet line 20, the motor control lines 22,24 and the return lnes 34, 36 and 38. A valve spool 58 is reciprocably mounted within the bore 56 and is operative upon shifting in either direction from the neutral position shown to selectively provide communication between either the inlet or supply conduit 20 and a respective one of the motor control lines 22 and 24 and the other motor control line and low pressure return lines 38 and 40 respectively. The valve spool 58 is provided with the usual annular grooves 60, 62, 64 and 66 which are operative to provide the communication between the respective passages in the valve body. Intermediate the grooves are formed the usual lands which are effective to block the bore between the respective annular passage means at the communication of the various inlet and outlet passageways with the bore.

The respective ends of the main control spool 56 define opposed piston means 68 and 70 which cooperate with the ends of the bore 56 to define chamber 72 and 74 for receiving fluid from the pilot system. Pilot fluid is directed by way of pilot control valve 46 to either end of the valve spool 58, that is, to either the chambers 72 or 74, and for acting on the respective piston means 68 or 70 for shifting the valve spool 58 in a direction away from the respective pressurized chamber.

Centering means 76 of a novel construction, to be described, is provided at each end of the spool of bias the spool to its neutral position as shown. While in the neutral position, fluid flowing into the bore 56 by way of supply conduit 20 flows along the spool 58 at grooves 62 and 64 and outward along outlets 38a and 38b to return passage 38 and return line 40 to sump 18. It will be appreciated that instead of connecting the outlets 38a and 38b to the return passage 38, such outlets may be alternately utilized to communicate pressurized fluid to another control valve such as in a bank of valves, not shown.

Pressure responsive controlling means are provided to control motor torque in response to operator control position and load pressure. The pressure controlling means of the present invention which is operative in response to pressure in the motor ports or lines to assist in modulating the control valve comprises generally, means such as a pair of pistons 78 and 80 reciprocably disposed in bores 82 and 84 formed in the end caps 55 and 57 at each end of the valve spool 58 and bore 56 and are generally axially thereof. The pistons are operatively connected as by bearing at their inner ends against the ends of the spool 58 and the outer ends thereof define with the respective bores 82 and 84 chambers which are communicated by suitable means such as conduit means 86 and 88 with the respective opposite motor control port. A conduit means 86, for example, communicates the left hand piston 78 and bore 82 with the right hand conduit 24. Likewise, the conduit 88 communicates fluid pressure in the motor port 22 with the bore 84 where it acts on piston 80. This provides a feedback of motor line pressure for acting on the spool 58 for assisting in controlling the displacement of the spool in proportion to motor line pressure and the pilot control pressure. The motor line pressure will be a direct function of the torque or load on the motor and the pilot pressure will be proportional to the displacement of the pilot control valve 46 and likewise the manual control lever or knob 47 by which it is controlled.

The centering means includes a pair of identical assemblies indicated generally at 76 with one at each end of the valve spool comprises zero rate spring centering means acting on each end of the spool 58 to provide a constant force centering means. The zero rate centering means is such that the centering force acting on the spool does not vary with the displacement of the spool but is constant regardless of displacement. The centering means also includes emergency centering means which will also be described hereinafter.

Figure 2:
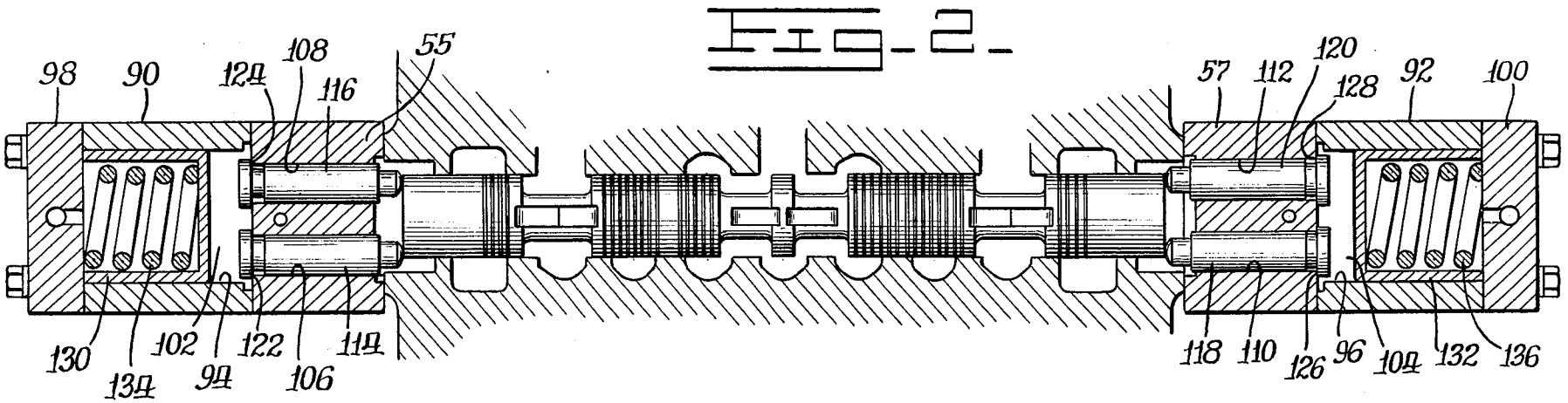
FIG. 2 is a sectional view taken generally along lines II—II of FIG. 1.

The centering means as shown in FIG. 2 comprises a pair of identical assemblies, each of which includes a housing 90 and 92, bores 94 and 96 concentric with bore 56 at each end thereof and secured to caps or housings 55 and 57. The bores 94 and 96 are closed by end caps 98 and 100 having a cylindrical bore for defining pressure chambers 102 and 104. A pair of bores 106, 108 and 110, 112 are formed in the members 55 and 57. Suitable pistons 114, 116, 118 and 120 are reciprocably mounted in the bores and have one end in abutting engagement with the end of spool 58 and the opposite end in communication with pressure chambers 102 and 104. Each of the piston means preferably includes an enlarged head defining annular stop means 122, 124 and 126, 128 respectively for engagement with the housing members 55 and 57 when the spool 58 is in its centered or neutral position.

Turning back briefly to FIG. 1 conduit means 106 and 108 communicate fluid from an independent pilot source 48 (i.e. independent of the primary source of motive fluid 14) by way of suitable passage means 110 and 112 in the cap or housing members 55 and 57 for communication with the chamber 102 and 104 of the respective centering means. The pressurized fluid thus introduced into the chambers 102 and 104, acts on pistons 114, 116 and 118, 120 to bias them against the end of piston means 68 and 70 the spool 58 and thus biasing the spool to the right or left toward its centered position. The pilot fluid being of a constant pressure will, therefore, exert a constant pressure on pistons 114, 116, 118 and 120 and thus, a constant pressure for centering the spool 58.

The safety or emergency centering means of the present invention comprises plungers or pistons 130 and 132 reciprocably mounted within the bores 94 and 96 and biased by spring means 134 and 136 against the head of pistons 114, 116 and 118, 120 for biasing them toward the end of the spool 58 and thus, the spool 58 to the centered position. However, it will be noted that the plungers 130 and 132 also define piston means such that pressurized fluid introduced to the chambers 102 and 104 force the piston means or plunger means as illustrated in FIGS. 1 and 2 away from the heads of pistons 114, 116 and 118, 120 to permit fluid operation thereof by the constant force centering means. Should pressure fail within the chambers 102 and 104, the springs 134 and 136 will force plungers 130 and 132 against the heads of the piston 114, 116 and 118, 120 and thus, bias the control valve 58 to its centered position. Thus, the valve 58 will be automatically returned to its neutral position to shut down the motor 16 should pilot pressure of the system fail.

Figure 3:
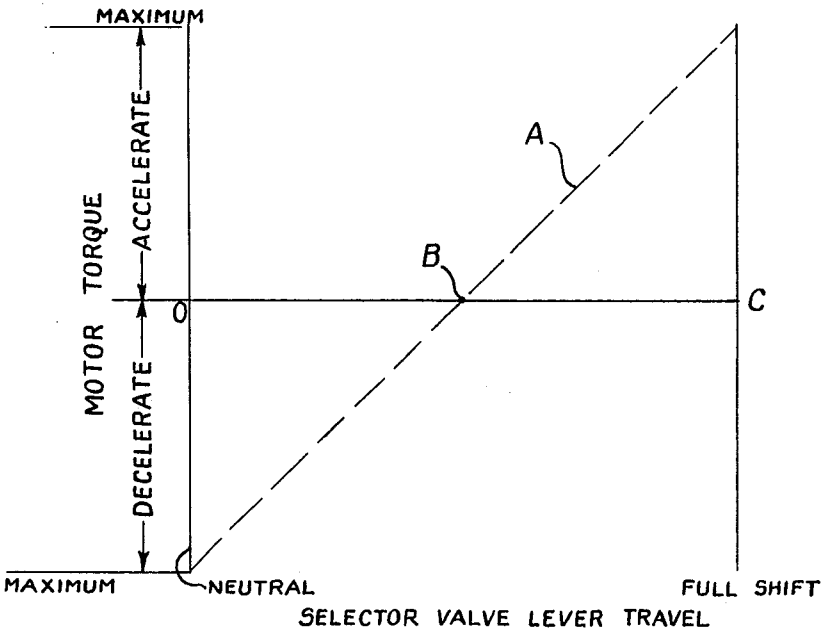
FIG. 3 is a graphic illustration of motor torque plotted vertically against control lever travel for the present system.

The graph in FIG. 3 illustrates the relationship of motor torque and control lever displacement. Motor torque is plotted vertically as against lever displacement plotted horizontally with zero torque and displacement indicated at point 0 where the vertical and horizontal axis intersect. Motor acceleration is depicted by curve A which intersects line O-C at point B.

Upon movement of the control lever 47 (FIG. 1) from its neutral position (0) (FIG. 3), pilot pressure for shifting the main control valve spool 58 will begin to build up in chamber 72 or 74. When the control lever 47 reaches point B (FIG. 3), sufficient pilot pressure will have built up in 72 or 74 to shift spool 58 to a position just beginning to open and communicate primary or working fluid from primary source 14 to motor 16. As the lever 47 is shifted past point B, the spool 58 is shifted further from its neutral position communicating a greater amount of fluid to the motor 16 causing the torque of the motor to increase and the motor to accelerate. Because of the relationship between the pilot fluid pressure, the centering pressure, and the working pressure of the system, the torque on the motor 16 will have a direct relationship to the position of the control lever 47. The main control spool 58, on the other hand will vary in position to maintain a constant torque of the motor.

After the motor has been brought up to a given speed, movement of control lever back past point B toward neutral (0), will cause a negative torque of the motor as indicated by the portion of line A below line O-C. The motor will experience maximum deceleration when lever 47 is moved back to the neutral (O) position.

This control arrangement of the present invention provides a system wherein feedback from the motor 16, which feedback pressure is responsive or proportional to the load or torque on the motor 16, will act against the spool 58 by means of pistons 78 and 80 tending to move it to a position reducing the fluid pressure to the motor 16 to maintain a substantially constant torque on the motor for a given control lever setting. This function of this system will be appreciated from the following description of the operation of the system.

OPERATION

The pilot control means shifts the main control valve spool 58 in the usual manner such that, should the operator decide to shift the valve 58 to the right to provide communication between inlet or supply conduit 20 via conduit 44 to the motor control line 22, such communication between conduit 44 and 22 are established by the annular groove 60 when spool 58 is shifted to the right. Such shifting occurs when pilot pressure line 50 is communicated with pump 48 to introduce pressurized pilot fluid into chamber 72 wherein the fluid acts on piston face 68 to shift the spool to the right against the force of the centering means. Pressurization of fluid from the main supply pump 14 to motor control line 22 also communicates that fluid via conduit 88 to piston 80 which acts on spool 58 at the right hand thereof for providing a force opposing shifting of the spool to the right. Opposition to movement of stem 58 is always provided by the forces from both the load piston 80 and the centering pistons 118 and 120 on the right end of the valve when applying pilot pressure to the left end of the stem.

It will be appreciated that the pressure in the motor line 22 will vary with the load on motor 16. The pilot pressure, on the other hand is from an independent source and thus, remain substantially constantly independent of the load on the system. As is common practice in such systems, the pilot pressure is generally of lower pressure than that of the working pressure in the system as was supplied from pump 14. Accordingly, the pistons which are responsive to the pilot pressure are larger in diameter than those which are subject to the working pressure of the working system. The relationship of the size of the compensator pistons to those of the pilot control pistons is such that when the high working pressures are present in the working system, the pressure controlling means will be effective to act in opposition to the pilot pressure acting for shifting of the valve spool 58 from neutral to its open position. Accordingly, a modulation of the working fluid by the main control valve will occur in proportion to the pressure in the working system. Thus, the system will accordingly modulate the flow of fluid across valve spool 58 of the main working system automatically and overcome or reduce any tendency for rapid acceleration of the motor. The system will function to maintain a substantially constant torque on the motor regardless of the speed of the motor.

The constant force centering means as pointed out above will insure that the force necessary to move the spool a given distance as determined by the centering means will be constant throughout the entire range of movement of the spool. Thus, the response of the spool to the pressure controlling system will be immediate and directly proportional to the load on the motor as determined by the pressure in the motor control line.

The valve spool and its controlling system works in the same manner when shifting for reverse drive of the motor 16. The valve spool and compensator, of course, can be adapted for use with any type of hydraulic motor.

Many modifications will be apparent, however, the invention is to be limited only by the scope of the appended claims.

I claim:

1. In a fluid motor control system for a reversable hydraulic motor having first and second fluid ports, a pilot operated directional control valve comprising, a valve having a bore provided therein and, a valve spool reciprocally slidable within the bore, first and second motor control ports and first and second motor exhaust ports provided in said housing in communication with said bore.

first motor conduit means for communicating the first motor control port with a first fluid motor port, and second motor conduit means for communicating the second motor control port with a second fluid port in a motor, pilot pressure reaction chambers provided in the housing facing each opposite end area of the valve spool whereby pilot fluid pressure therein will act upon respective ends of the valve spool, a pilot control valve in communication with a source of constant pilot pressure for selectively communicating pilot pressure to one of said pilot pressure reaction chambers for selective shifting of the valve spool, pilot pressure conduit means communicating said pilot control valve with the respective pilot pressure reaction chambers, a high pressure fluid inlet port provided in the valve body in communication with the bore and with a source of high pressure fluid independent of and separate from said source of pilot pressure, sump outlet port means provided in the valve body, and wherein the valve spool is shiftable from a neutral, centered position in which the high pressure fluid inlet port is communicated through the valve bore with the sump outlet port means, to first and second motor control positions respectively in which the high pressure fluid inlet port is communicated with the first and second motor control ports respectively and the first and second motor exhaust ports are communicated with the sump outlet means respectively, constant force spool biasing means comprising, first and second biasing piston means slidably disposed in the valve housing at respective opposite ends of the bore abutting the respective ends of the valve spool in its neutral position, and a single one of said first and second biasing piston means engaging said valve spool when it is respectively shifted from its neutral position, conduit means constantly communicating constant pilot pressure with said biasing piston means, first and second modulating piston means slidably diposed in the valve housing at respective opposite ends of the valve spool and abutting the ends of the valve spool, and first and second modulating conduit means communicating the first motor control conduit with the second modulating piston means, and the second motor control conduit with the first modulating piston means, whereby fluid pressure supplied through the control valve and a motor conduit means for driving the motor will be communicated to a modulating piston to urge the valve spool toward closing of the motor conduit means together with the constant pilot pressure bias and against the selected pilot control pressure acting on the spool, whereby the hydraulic motor output is directly proportional to the pilot valve selector displacement.

2. The invention defined in claim 1 further comprising safety centering means for automatically centering the valve spool when the pilot fluid pressure fails.

3. The control system of claim 2 wherein said safety centering means comprises centering piston means disposed at each opposite end of said spool;

spring means for biasing said centering piston means toward said spool for engagement therewith upon failure of said pilot fluid pressure; and means for communicating pilot fluid to said centering piston means for biasing said centering piston means out of engagement with the ends of said spool.

* * * * *

UNITED STATES PATENT OFFICE

CERTIFICATE OF CORRECTION

Patent No. 4,041,983 Dated August 16, 1977

Inventor(s) Donald L. Bianchetta

It is certified that error appears in the above-identified patent and that said Letters Patent are hereby corrected as shown below:

column 8, line 2 the word "diposed" should be replaced with --disposed--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*